US007590366B2

(12) United States Patent
Nakayama

(10) Patent No.: US 7,590,366 B2
(45) Date of Patent: Sep. 15, 2009

(54) IMAGE HEATING APPARATUS AND GLOSSINESS INCREASING APPARATUS

(75) Inventor: Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/749,527

(22) Filed: May 16, 2007

(65) Prior Publication Data

US 2007/0217803 A1 Sep. 20, 2007

Related U.S. Application Data

(62) Division of application No. 11/299,960, filed on Dec. 13, 2005, now Pat. No. 7,263,303.

(30) Foreign Application Priority Data

Dec. 14, 2004 (JP) ..... 2004/361699

(51) Int. Cl.
*G03G 15/20* (2006.01)

(52) U.S. Cl. ..... 399/67; 399/68; 399/69; 399/341

(58) Field of Classification Search ..... 399/68, 399/69, 70, 320–342
See application file for complete search history.

(56) References Cited

U.S. PATENT DOCUMENTS

| | | | | |
|---|---|---|---|---|
| 6,795,661 | B2 | 9/2004 | Kanesawa et al. | 399/69 |
| 2004/0057741 | A1 * | 3/2004 | Uehara et al. | 399/69 |
| 2005/0220506 | A1 | 10/2005 | Nakayama | 399/323 |
| 2006/0245798 | A1 | 11/2006 | Nakayama | 399/329 |

FOREIGN PATENT DOCUMENTS

| | | | |
|---|---|---|---|
| JP | 4-245275 | | 9/1992 |
| JP | 9-325631 | | 12/1997 |
| JP | 11-52781 | | 2/1999 |
| JP | 2000075710 | A * | 3/2000 |
| JP | 2002-221834 | A | 8/2000 |
| JP | 2000-221821 | | 8/2002 |
| JP | 2002-304072 | A | 10/2002 |
| JP | 2002-372882 | A | 12/2002 |
| JP | 2003-029485 | A | 1/2003 |
| JP | 2003029485 | A * | 1/2003 |
| JP | 2003-270991 | | 9/2003 |
| JP | 2003-280414 | A | 10/2003 |
| JP | 2003345156 | A * | 12/2003 |

* cited by examiner

OTHER PUBLICATIONS

Translation of Chinese Notification of the First Office Action in Chinese Patent Application No. 200510129634.8, dated Jan. 25, 2008.

*Primary Examiner*—David M Gray
*Assistant Examiner*—Erika Villaluna
(74) *Attorney, Agent, or Firm*—Fitzpatrick, Cella, Harper & Scinto

(57) ABSTRACT

An image heating apparatus includes a first image heating device for heating a toner image on a recording material. A first temperature detector is provided for detecting a temperature of the first image heating device. A second image heating device is also provided for heating the toner image on the recording material heated by the first image heating device, and a second temperature detecting device is provided for detecting a temperature of the second image heating device. Still further, a controller is provided for changing a number of recording materials passing through the first image heating device and the second image heating device per unit time on the basis of the detected temperature by the first image heating device and a detected temperature by the second image heating device.

5 Claims, 9 Drawing Sheets

IMAGE HEATING APPARATUS AND GLOSSINESS INCREASING APPARATUS

CROSS-REFERENCE TO RELATED APPLICATION

This application is a divisional of application Ser. No. 11/299,960, filed Dec. 13, 2005.

FIELD OF THE INVENTION AND RELATED ART

The present invention relates to an image heating apparatus for heating an image on recording medium, and a glossiness increasing apparatus. An image heating apparatus and a glossiness increasing apparatus are employed by such an image forming apparatus as a copying machine, a printer, a facsimileing machine, etc.

In recent years, demand has been growing for an image forming apparatus, for example, a copying machine, a printer, etc., capable of adjusting a level of glossiness, at which it forms an image, according to the glossiness of the recording medium; more specifically, an image forming apparatus which outputs an image which is relatively high in glossiness, when coated paper, photographic printing paper, or the like, is used as recording medium for outputting a color image, and outputs an image which is relatively low in glossiness, when a black-and-white document, or a color document for ordinary business, is outputted. In other words, in recent years, demand has been growing for an image forming apparatus capable of forming an image which is very wide in terms of the glossiness level range, in which it can form an image.

For the purpose of satisfying this demand as much as possible, some of recent electrophotographic image forming apparatuses, and the like, are provided with an image heating apparatus of the so-called tandem type (which hereinafter will be referred to simply as fixing apparatus), which is made up of multiple image heating apparatuses (which hereinafter will he referred to as fixing device), which are disposed in the so-called tandem fashion. As examples of an image forming apparatus provided with a fixing apparatus of the tandem type, the following have been known.

An image forming apparatus of the tandem type, which affects the level of glossiness at which an image is formed, in addition to fixing an image, has two or more image heating devices, and the greater the number of the image heating devices with which an image heating apparatus of the tandem type is provided, the more the latitude which the image heating apparatus of the tandem type is afforded in terms the amount by which heat and pressure can be applied to an image from the image heating apparatus, making it possible to afford the image heating apparatus of the tandem type more latitude, in terms of the level of glossiness achievable by an image heating apparatus.

As examples of the structure of an image heating apparatus of the so-called tandem type, such as the above described one, the following can be mentioned.

Japanese Laid-open Patent Application 4-245275 discloses a fixing apparatus comprising a pair of fixing devices, each of which is made up of a heat roller and a pressure roller. The heat roller and pressure roller are kept pressed upon each other, forming a pressure nip with a preset amount of internal pressure. In other words, the fixing apparatus has a first pressure nip and a second pressure nip. As a sheet of paper onto which a toner image, or toner images, have been transferred, is conveyed through the first and second pressure nips, not only are the toner images satisfactorily fixed to the sheet of paper, but also, they are increased in glossiness. In other words, with the use of the pair of fixing devices, an image with a higher level of glossiness is obtained.

Further, Japanese Laid-open Patent Application 2000-221821 discloses a fixing apparatus comprising multiple fixing devices disposed in tandem in the direction in which a sheet of recording medium is conveyed. The fixing apparatus is designed so that it can be changed in the number and position of the nips which the multiple fixing devices form one for one, enabling a user to switch the amount of heat it applies to a sheet of recording medium and toner images thereon, according to the level of glossiness desired by the user. In other words, the fixing apparatus enables a user to adjust the level of glossiness at which an image is formed, to a level desired by the user.

Further, Japanese Laid-open Patent Application 2003-270991 discloses a method for reducing in electric power consumption an image forming apparatus enabled to operate in the normal print mode in which a first fixing device is used, and the high gloss print mode in which a high gloss image is obtained by fixing (second fixation) an image with the use of a second fixing device after the image is fixed (first fixation) with use of a first fixing device. More specifically, the second fixing device is rendered narrower in the width of the fixation nip, in terms of the recording medium conveyance direction, than the first fixing device. Further, when in the high gloss print mode in which high gloss paper is used, the fixation temperature (target temperature) of the first fixing device is set to a level lower than the level for the normal print mode, the fixing apparatus is reduced in productivity, and each halogen heater is controlled in activation and reactivation, in order to reduce the total amount of electric power consumed by the two fixing devices.

On the other hand, the total amount of the electric power usable by an image forming apparatus is determined by the specifications of the power source used by the apparatus. Therefore, the amount of the electric power available for a fixing apparatus is limited. If the amount of the electric power available for fixation is insufficient, the temperature of a fixation roller gradually falls as a printing operation progresses, falling eventually into a range in which an image with an insufficient level of glossiness is formed, and/or an image is unsatisfactorily fixed.

As the above described phenomena occur, that is, as the temperature of the fixation roller substantially falls while an image is outputted, the level of glossiness at which an image is being formed falls, making it difficult to achieve the desired level of glossiness level. In other words, the problem that an image which is nonuniform in glossiness is outputted occurs. In particular, in a job in which multiple sheets of recording medium are continuously conveyed to form an image thereon, the problem that the images outputted during the early period of the job are different glossiness from those outputted during the late period of the job, occurs in spite of the fact that the two groups of images are copies of the same image.

Thus, it is possible to reduce the amount of heat robbed by images per unit length time, by reducing the image forming apparatus in throughput, from the beginning of a job, when the job is to be done in the high gloss mode. This method, however, is substantial in the loss of productivity.

In addition, if a fixation roller is large in thermal capacity, it is difficult to instantly restore the temperature of the fixation roller, which has substantially fallen, to the preset level, during an image formation job. Therefore, a problem similar to the above described problem also occurs if a fixation roller is large in thermal capacity.

SUMMARY OF THE INVENTION

The primary object of the present invention is to provide an image heating apparatus which does not diminish in the level of the glossiness given to an image.

Another object of the present invention is to provide a gloss increasing apparatus which is stable in the level of the gloss it adds to an image.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the present invention will be concretely described with reference to the following embodiments of the present invention. Incidentally, although the following embodiments of the present invention are examples of the most preferable embodiment of the present invention, they are not intended to limit the scope of the present invention.

Embodiment 1

(1) Example of Image Forming Apparatus

Figure 1:
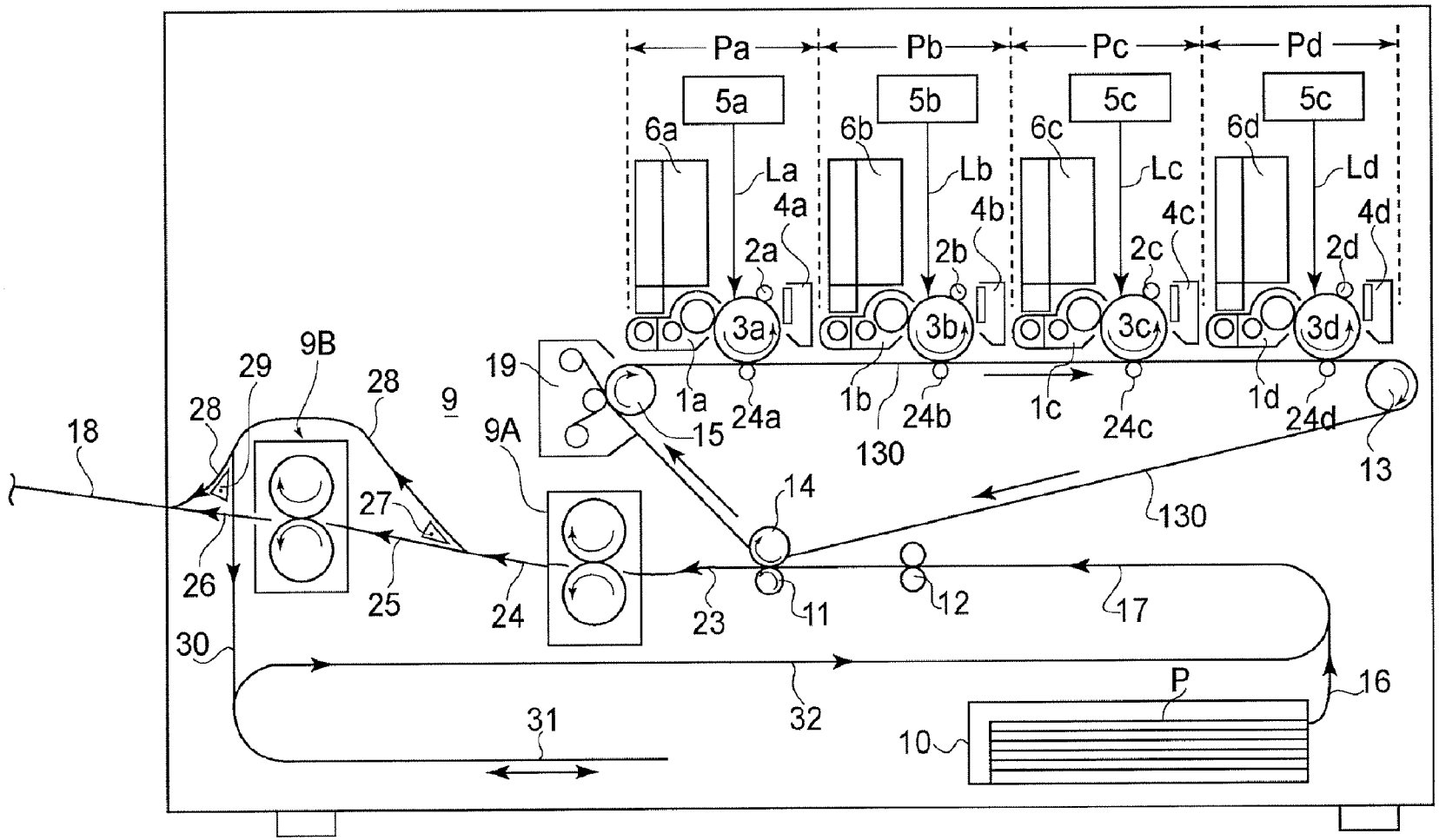
FIG. 1 is a schematic drawing of the image forming apparatus in the first embodiment of the present invention, showing the general structure thereof.

FIG. 1 is a schematic drawing of the image forming apparatus in this embodiment, showing the general structure thereof. This image forming apparatus is a color laser printer of the tandem type, as well as the transfer type, which employs one of the electrophotographic image forming methods.

This image forming apparatus is provided with four image formation stations Pa, Pb, Pc, and Pd, or first, second, third, and fourth image formation stations, respectively, which are disposed in parallel in the image forming apparatus. When the image forming apparatus is in the color print mode, toner images different in color are formed in the four image formation stations, one for one, through the processes of forming a latent image, developing the latent image, and transferring the developed latent image.

The image formation portions Pa, Pb, Pc, and Pd are provided with their own image bearing members, which in this embodiment are electrophotographic photosensitive drums 3*a*, 3*b*, 3*c*, and 3*d*, respectively, on which toner images different in color are formed one for one. The image forming apparatus is also provided with an intermediary transfer member 130 (intermediary transfer belt), which is disposed in contact with the photosensitive drums 3*a*, 3*b*, 3*c*, and 3*d*. After the formation of the toner images, different in color, on the photosensitive drums 3*a*, 3*b*, 3*c*, and 3*d*, one for one, they are transferred (primary transfer) onto the intermediary transfer member 130, and then, are transferred (secondary transfer) from the intermediary transfer member 130 onto a sheet P of recording medium in the second transfer station. After the transfer (secondary transfer) of the toner images onto the sheet P, the sheet P is introduced into a first fixing apparatus 9A (fixing device; fixing means) as a first image heating means, and then, is introduced into a second fixing apparatus 9B as a second image heating means. In other words, the sheet P and the images thereon are subjected twice to heat and pressure. Thereafter, the sheet P, which is bearing a fixed color image, is discharged as a color print into a delivery tray 18 attached to the exterior of the image forming apparatus.

In the adjacencies of the peripheral surfaces of the photosensitive drums 3*a*, 3*b*, 3*c*, 3*d* as image bearing means, charging devices 2*a*, 2*b*, 2*c*, and 2*d*, developing apparatuses 1*a*, 1*b*, 1*c*, and 1*d* as developing means, primary transfer charging devices 24*a*, 24*b*, 24*c*, and 24*d* as transferring means, and cleaners 4*a*, 4*b*, 4*c*, and 4*d* as cleaning means, are disposed, respectively. Further, in the space above the space for the photosensitive drums, laser scanners 5*a*, 5*b*, 5*c*, and 5*d* as optical scanning means are disposed.

The photosensitive drums 3*a*, 3*b*, 3*c*, and 3*d* are rotationally driven in the counterclockwise direction indicated by an arrow mark. As they are rotationally driven, their peripheral surfaces are uniformly charged (primary charging) to preset polarity and potential level by the drum charging devices 2*a*, 2*b*, 2*c*, and 2*d*, respectively. The uniformly charged peripheral surfaces of the photosensitive drums 3*a*, 3*b*, 3*c*, and 3*d*, are exposed to beams La, Lb, Lc, and Ld of laser light, which are projected, while being modulated with video signals, from the laser scanners 5*a*, 5*b*, 5*c*, and 5*d* in a manner to scan the peripheral surfaces. As a result, latent images which reflect the video signals are formed on the photosensitive drums 3*a*, 3*b*, 3*c*, and 3*d*. Each of the laser scanners 5*a*, 5*b*, 5*c*, and 5*d* is provided with its own light source, polygon mirror, etc. The beam of laser light emitted from the light source is reflected by the polygon mirror which is being rotated. As a result, the beam of laser light is oscillated. The oscillatory flux of laser light is deflected by a deflection mirror, and is focused by an f-θ lens onto the generatrix of the photosensitive drum 3; the peripheral surface of the photosensitive drum 3 is exposed. As a result, latent images which reflect the video signals are formed on the peripheral surfaces of the photosensitive drums 3*a*, 3*b*, 3*c*, and 3*d*, one for one.

The developing devices 1*a*, 1*b*, 1*c*, and 1*d* are filled with preset amounts of cyan, magenta, yellow, and black toners, as developers, supplied by toner supplying apparatuses 6*a*, 6*b*, 6*c*, and 6*d*, respectively.

The developing devices 1*a*, 1*b*, 1*c*, and 1*d* develop the latent images on the photosensitive drums 3*a*, 3*b*, 3*c*, and 3*d* into visible images, that is, toner images of cyan, magenta, yellow, and black colors, respectively.

The intermediary transfer member 130 is an endless belt stretched around a set of three rollers 13, 14, and 15 disposed in parallel, and is rotationally driven in the clockwise direction indicated by an arrow mark, at roughly the same peripheral velocities as those of the photosensitive drums 3*a*, 3*b*, 3*c*, and 3*d*.

The toner image of the abovementioned yellow color, that is, the first color, formed on the photosensitive drum 3*a* in the first image formation portion Pa, is conveyed through the nip between the photosensitive drum 3*a* and intermediary transfer member 130. While the yellow toner image is conveyed through the nip, it is transferred (primary transfer) onto the outward surface of the intermediary transfer member 130 by the combination of the electric field generated by the primary transfer bias applied to the intermediary transfer member 130, and the pressure in the nip.

Similarly, the toner images of the magenta, cyan, and black colors, that is, the second, third, and fourth colors, formed on the photosensitive drums 3*b*, 3*c*, and 3*d* in the second, third, and fourth image formation portions Pb, Pc, and Pd, respectively, are sequentially transferred in layers onto the intermediary transfer member 130, effecting thereby a single synthesized multicolor image which matches in color the intended image, on the intermediary transfer member 130.

Designated by a referential numeral 11 is a secondary transfer roller, which is kept pressed against the roller 14, that is, one of the aforementioned set of three rollers 13, 14, and 15 around which the intermediary transfer member 130 is stretched, forming thereby a second transfer nip, with the intermediary transfer member 130 pinched between the roller 14 and secondary transfer roller 11.

Meanwhile, the sheets P of recording medium in a sheet feeder cassette 10 are fed into the main assembly of the image forming apparatus, while being separated one by one. Then, each sheet P is conveyed through sheet paths 16 and 17, the nip between a pair of registration rollers 12, and a pre-transfer guide, so that it will be delivered to the secondary transfer nip, that is, the nip between the intermediary transfer member 130 and transfer roller 11, with a preset timing, and is conveyed through the secondary transfer nip. As the sheet P is conveyed through the secondary transfer nip, a secondary transfer bias is applied to the secondary transfer roller 11 from a bias power source. As a result, the four toner images, different in color, having been transferred in layers onto the intermediary transfer member 130 and effecting the single synthesized multicolor toner image, are transferred (secondary transfer) all at once onto the sheet P of recording medium.

After the transfer of the synthesized multicolor image onto the sheet P of recording medium in the secondary transfer nip, the sheet P is separated from the intermediary transfer member 130, and is guided into a fixing apparatus 9 (image heating apparatus) through a sheet path 23.

This fixing apparatus 9 is provided with two image heating means: first and second fixing devices 9A and 9B. It is structured so that a sheet P of recording medium can he conveyed through the second fixing device 9B, which is on the downstream side of the first fixing device 9A in terms of the sheet conveyance direction, after it is conveyed through the first fixing device 9A, or the upstream fixing apparatus. More specifically, first, the sheet P is introduced into the first fixing device 9A, in which the synthesized multicolor image is fixed (first fixation) to the sheet P by heat and pressure. Then, the sheet P is guided by sheet paths 24 and 25 into the second fixing device 9B, in which the synthesized multicolor image is fixed again (second fixation) by heat and pressure. Then, the sheet P having the fixed image is discharged as a multicolor print, through the sheet path 26 into the delivery tray 18 attached to the exterior of the image forming apparatus main assembly.

After the completion of the image transfer from the photosensitive drums 3*a*, 3*b*, 3*c*, and 3*d* (primary transfer), the photosensitive drums 3*a*, 3*b*, 3*c*, and 3*d* are cleaned by the cleaners 4*a*, 4*b*, 4*c*, and 4*d*, respectively; the transfer residual toner on the photosensitive drum are removed by the cleaners, preparing the photosensitive drums for the formation of the following latent images.

The image forming apparatus is structured so that the toner and other unwanted matters remaining on the intermediary transfer belt 130 are wiped away by a cleaning web 19 (piece of unwoven fabric) disposed in contact with the surface of the intermediary transfer belt 130.

When the image forming apparatus is in the black-and-white (or monochromatic color) print mode, only the fourth image formation station Pd, which is for forming the black toner image, is made to form an image, among the first to fourth image formation stations Pa, Pb, Pc, and Pd.

If the low gloss mode is selected for outputting an image with a relatively low level of gloss, for example, a black-and-white image, or for printing a multicolor image on a sheet of high quality paper, the sheet P of recording medium is introduced into the first fixing device 9A through the sheet path 23, after toner images are transferred (secondary transfer) onto the sheet P in the secondary transfer nip. In the first fixation device 9A, the toner images on the sheet P are fixed to the sheet P with heat and pressure. Then, the first flapper 27 is controlled to guide the sheet P from the sheet path 24 into a bypass 28 for bypassing the second fixing device 9B. Therefore, the sheet P is discharged into the delivery tray 18 without being conveyed through the second fixing device 9B.

Further, if the aforementioned low gloss print mode is selected in combination with the two-sided copy mode, an image is formed on one of the two surfaces of a sheet P of recording medium, and the sheet P is conveyed through the first fixing device 9A, in which the image on the sheet P is fixed. After the sheet P is conveyed out of the fixing device 9A, it is guided into the bypass 28. Then, a second flapper 29 is controlled so that the sheet P is guided into a two-sided printing path 31 on the sheet recirculating mechanism side. Then, the sheet P is guided into a switch back sheet path 31. Then, the sheet P is pulled out of this sheet path 31, and is guided into the sheet recirculating path 32, being thereby placed upside down. Thereafter, the sheet P is conveyed from this sheet path 32 into the sheet path 17, and is reintroduced, while remaining placed upside down, into the secondary transfer nip, that is, the interface between the intermediary transfer belt 130 and secondary transfer roller 11, with a preset timing, by the pair of registration rollers 12, through the pre-transfer guide. Then, the toner images on the intermediary transfer belt 130 are transferred (secondary transfer) onto the other surface (second surface) of the sheet P. After the transfer (second transfer) of the toner images onto the second surface of the sheet P in the second transfer nip, the sheet P is separated from the intermediary transfer member 130, and is guided into the first fixing device 9A through the sheet path 23, in which the toner images on the second surface of the sheet P are fixed thereto by heat and pressure. Thereafter, the first flapper 27 is controlled so that the sheet P is guided from the sheet path 24 into the bypass 28 for bypassing the second fixing device 9B. As a result, the sheet P is discharged as a two-sided print into the delivery tray 18, without being conveyed through the second fixing device 9B.

(2) Fixing Apparatus 9

Figure 2:
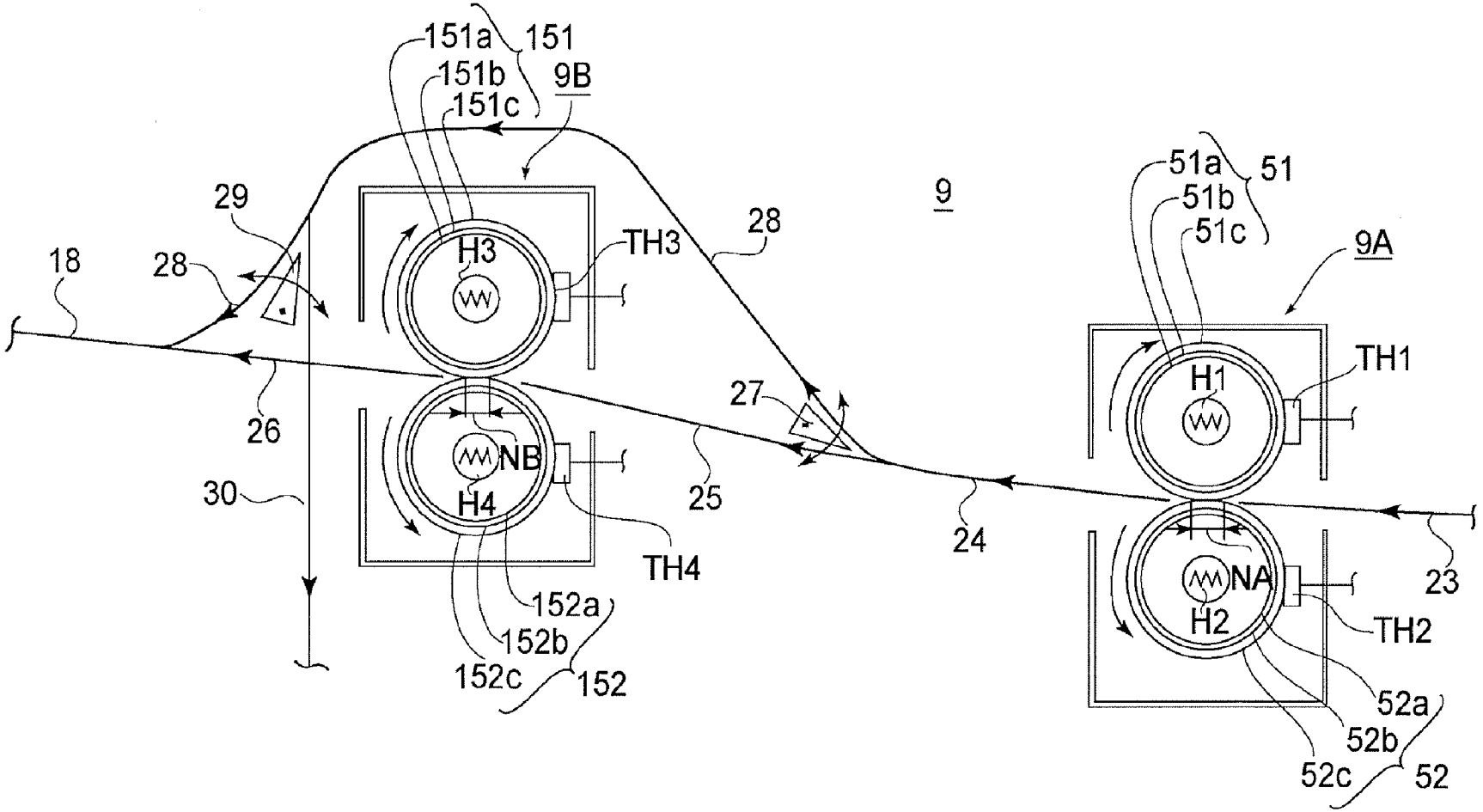
FIG. 2 is an enlarged drawing of the fixing apparatus portion of the image forming apparatus.

FIG. 2 is an enlarged view of the fixing apparatus 9 having the first and second fixing devices 9A and 9B disposed in tandem, and its adjacencies. In terms of the recording medium conveyance direction, the first fixing apparatus 9A is the one on the upstream side, and the second fixing apparatus 9B is the one on the downstream side.

The first and second fixing devices 9A and 9B are of the heat roller type, and are roughly the same in configuration. More specifically, the first fixing device 9A has a fixation roller 51 as a rotational image heating member, and a pressure roller 52 as a rotational pressure applying member, whereas the second fixing device 9B has a fixation roller 151 as a rotational image heating member, and a pressure roller 152 as a pressure applying member. The pressure rollers 52 and 152 are kept pressed upon the fixation rollers 51 and 151, forming nips (fixation nips) NA and NB, respectively. The fixation rollers 51 and 151 are rotationally driven in the clockwise direction indicated by an arrow mark by an unshown driving system. The pressure rollers 52 and 152 are rotated by the rotation of the fixation rollers 51 and 151.

1) First Fixing Device 9A

Regarding the structure of the fixation roller 51, as an image heating member, of the first fixing device 9A, which comes into contact with an unfixed tone image, the fixation roller 51 is made up of: a hollow aluminum cylinder as a metallic core 51*a* (hollow metallic core) having an external diameter of 75.0 mm; a 2.5 mm thick silicon rubber layer as an elastic layer 51*b* formed on the peripheral surface of the metallic core 51*a*; and a 30 μm thick PFA tube as a releasing layer 51*b* placed in a manner of covering the surface of the elastic layer 51*b*. The overall external diameter of the fixation roller 51 is roughly 80 mm. Within the hollow of the cylindrical metallic core 51*a* of the fixation roller 51, a halogen lamp heater H1 as a heating member is disposed. Further, a thermistor TH1 as a temperature detecting means (temperature sensor) is disposed in contact, or almost in contact, with the fixation roller 51.

As for the structure of the pressure roller 52 as a pressure applying member, the pressure roller 52 is made up of: a hollow aluminum cylinder as a metallic core 52*a* (hollow metallic core) having an external diameter of 76.0 mm; a 2.0 mm thick silicon rubber layer as an elastic layer 52*b* formed on the peripheral surface of the metallic core 52*a*; and a 30 μm thick PFA tube as a releasing layer 52*c* placed in a manner of covering the surface of the elastic layer 52*b*. The overall external diameter of the pressure roller 52 is roughly 80 mm. Within the hollow of the cylindrical metallic core 52*a* of the pressure roller 52, a halogen lamp heater H2 as a heating member is disposed. Further, a thermistor TH2 as a temperature detecting means is disposed in contact, or almost in contact, with the pressure roller 52.

The abovementioned fixation roller 51 and pressure roller 52 of the first fixing device 9A are kept pressed upon each other, forming the fixation nip NA having a width of roughly 10 mm (in terms of recording conveyance direction), with the application of a total pressure of 700 N.

2) Second Fixing Device 9B

Regarding the structure of the fixation roller 151, as an image heating member, of the second fixing device 9B, which comes into contact with a fixed tone image, the fixation roller 151 is made up of: a hollow aluminum cylinder as a metallic core 151*a* (hollow metallic core) having an external diameter of 77.0 mm; a 1.5 mm thick silicon rubber layer as an elastic layer 151*b* formed on the peripheral surface of the metallic core 151*a*; and a 30 μm thick PFA tube as a releasing layer 151*c* placed in a manner of covering the surface of the elastic layer 151*b*. The overall external diameter of the fixation roller 151 is roughly 80 mm. Within the hollow of the cylindrical metallic core 151*a* of the fixation roller 151, a halogen lamp heater H3 is disposed. Further, a thermistor TH3 as a temperature detecting means is disposed in contact, or almost in contact, with the fixation roller 151.

As for the structure of the pressure roller 152 as a pressure applying member, the pressure roller 152 is made up of: a hollow aluminum cylinder as a metallic core 152*a* (hollow metallic core) having an external diameter of 77.0 mm; a 1.5 mm thick silicon rubber layer as an elastic layer 152*b* formed on the peripheral surface of the metallic core 152*a*; and a 30 μm thick PFA tube as a releasing layer 152*c* placed in a manner of covering the surface of the elastic layer 152*b*. The overall external diameter of the pressure roller 152 is roughly 80 mm. Within the hollow of the cylindrical metallic core 152*a* of the pressure roller 152, a halogen lamp heater H4 as a heating member is disposed. Further, a thermistor TH4 as a temperature detecting means is disposed in contact, or almost in contact, with the pressure roller 152.

The abovementioned fixation roller 151 and pressure roller 152 of the first fixing device 9B are kept pressed upon each other, forming the fixation nip NB having a width of roughly 5 mm, with the application of a total pressure of 1,000 N.

The width of the nip NA of the first fixing device 9A is rendered greater than the width of the nip NB of the second fixing device 9B. Further, the average pressure in the nip NA of the first fixing device 9A is rendered greater than the average pressure in the nip NB of the second fixing device 9B. Incidentally, "average pressure" means the value obtained by dividing the amount of the pressure applied to a given area, by the size of the area.

Figure 3:
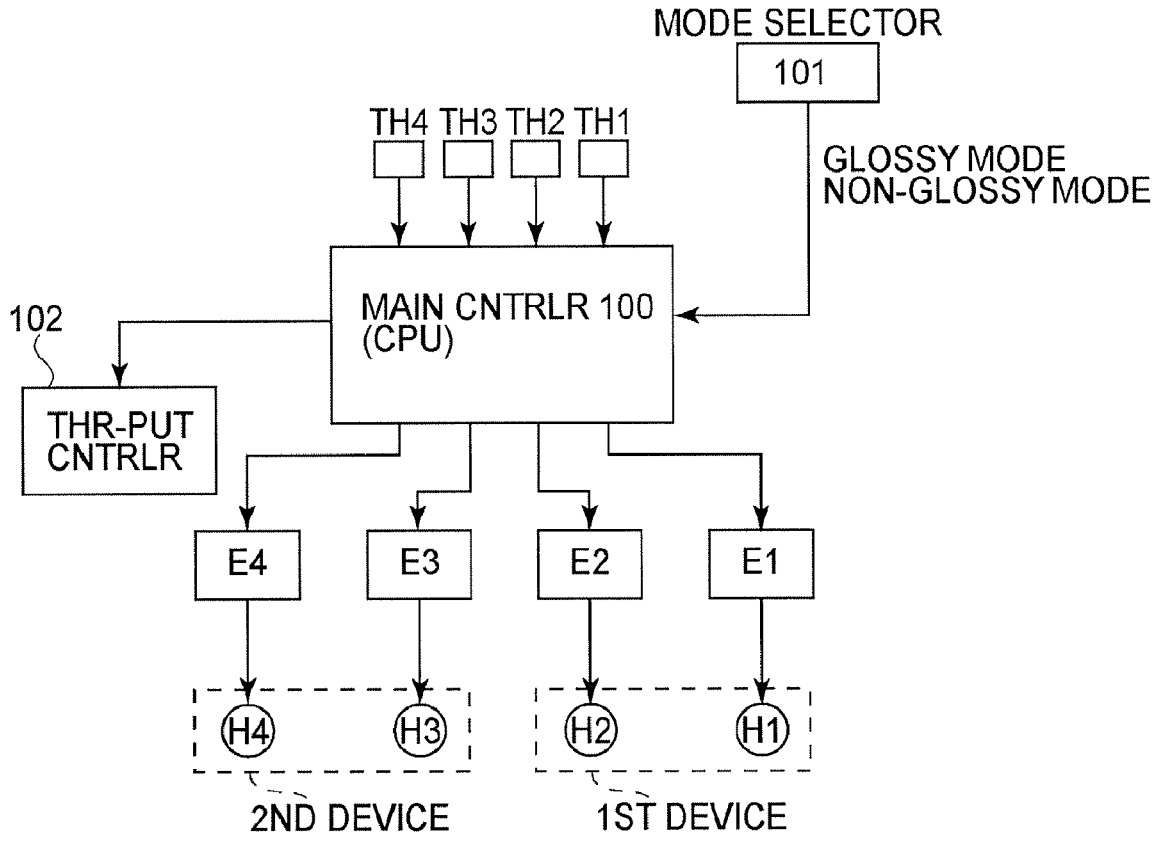
FIG. 3 is a block diagram of the system for controlling the temperature of the first and second fixing devices.

FIG. 3 is a block diagram of the temperature control system for controlling the temperature of the first and second fixing devices 9A and 9B. Designated by a referential symbol 100 is the control portion of the image forming apparatus main assembly (CPU), which controls the general image formation sequence of the image forming apparatus, inclusive of controlling the temperature of the first and second fixing devices 9A and 9B. Designated by referential symbols E1-E4 are electric power sources for supplying the heaters H1-H4, respectively, with electric power.

The fixation roller 51 of the first fixing device 9A is heated by the heat generated by the heater H1, to which electric power is supplied from the electric power source E1. The surface temperature of the fixation roller 51 is detected by the thermistor TH1, and this temperature information is fed back to the control portion 100 of the image forming apparatus main assembly (which hereinafter will be referred to as main control 100). The main control 100 controls the amount by which electric power is supplied from the electric power source El to the heater H1, so that the surface temperature of the fixation roller 51 fed back from the thermistor TH1 remains at a preset first target temperature T11 for the fixation roller 51 (first preset temperature), which in this embodiment is 180° C.

As for the pressure roller 52 of the first fixing device 9A, it is heated by the heat generated by the heater H2, to which electric power is supplied from the electric power source E2. The surface temperature of the pressure roller 52 is detected by the thermistor TH2, and this temperature information is fed back to the main control 100 of the image forming apparatus, which controls the amount, by which electric power is supplied from the electric power source E2 to the heater H2, so that the surface temperature of the pressure roller 52 fed back from the thermistor TH2 remains at a preset level, which in this embodiment is 140° C.

The fixation roller 151 of the second fixing device 9B is heated by the heat generated by the heater H3, to which electric power is supplied from the electric power source E3. The surface temperature of the fixation roller 151 is detected by the thermistor TH3, and this temperature information is fed back to the main control 100 of the image forming apparatus, which controls the amount by which electric power is supplied from the electric power source E3 to the heater H3, so that the surface temperature of the fixation roller 151 fed back from the thermistor TH3 remains at a preset second target temperature T21 for the fixation roller 151 (second preset temperature), which in this embodiment is 200° C.

As for the pressure roller 152 of the first fixing device 9B, it is heated by the heat generated by the heater H4, to which electric power is supplied from the electric power source E4. The surface temperature of the pressure roller 152 is detected by the thermistor TH4, and this temperature information is fed back to the main control 100 of the image forming apparatus, which controls the amount, by which electric power is supplied from the electric power source E4 to the heater H4, so that the surface temperature of the pressure roller 152 fed back from the thermistor TH4 remains at a preset level, which in this embodiment is 140° C.

Designated by a referential symbol 101 is a print mode selecting means for selecting the high gloss print mode or low gloss print mode. The print mode selecting means 101 is a part of the control panel (unshown) of the image forming apparatus. As an operator selects one of the two print modes with the use of the control panel, the selected print mode, which is the high gloss mode or low gloss mode, is transmitted to the main control 100.

The high gloss print mode is such a print mode that is used when printing in color on high gloss recording paper such as coated paper, whereas the low gloss print mode is such a print mode that is used for yielding a black-and-white print, or printing in color on high quality paper.

As the high gloss print mode is selected, the main control 100 controls the image forming apparatus so that after a synthesized multicolor toner image is transferred onto a sheet P of recording medium in the second transfer nip, the sheet P is sequentially conveyed through the first fixing device 9A and second fixing device 9B, and then, is discharged into the delivery tray 18. In other words, the sheet P and the image thereon are subjected to a total of two fixing processes.

On the other hand, as the low gloss print mode is selected, the main control 100 controls the image forming apparatus so that after a synthesized multicolor toner image is transferred onto a sheet P of recording medium in the second transfer nip, the sheet P is guided into the first fixing device 9A, and then, is guided by the first flapper 27 into the bypass 28 for bypassing the second fixing device 9B, in order to discharge the sheet P into the delivery tray 18 without conveying the sheet P through the second fixing device 9B. Further, as the low gloss print mode is selected in combination with the two-sided print mode, the main control 100 controls the second flapper 29 so that the sheet P is guided into the two-sided printing path 30 on the recording medium recirculating mechanism side.

(3) Electric Power Allocation to First and Second Fixing Devices 9A and 9B The image forming apparatus in this embodiment is equipped with an electrical plug with a specification of 200 V-15 A, being enabled to consume a total electric power of 3,000 W. Excluding the amount of the power used for image formation and recording medium conveyance, the average amount of the electric power available for the combination of the first and second fixing devices 9A and 9B is 1,600 W.

Hereinafter, the first and second fixing devices 9A and 9B will be abbreviated as first and second fix 9A and 9B, respectively.

In the low gloss print mode, a sheet P of recording medium is not conveyed through the second fix 9B. Therefore, the second fix 9B has only to be supplied with electric power by the amount sufficient to keep the temperature of the fix 9B at the target level, that is, to keep the fix 9B on standby. Thus, the rest is available for the fix 9A.

In the high gloss print mode, a sheet P of recording medium is conveyed through the second fix 9B. Therefore, the second fix 9B also has to be supplied with a sufficient amount of electric power.

In the high and low gloss print modes, the electric power allocation for the first and second fixes 9A and 9B were made as shown in the following table (Table 1).

TABLE 1

| | Power | |
|---|---|---|
| Print mode | Fist 9A | Second 9B |
| Low glossiness | 1200 W | 400 W |
| Glossy | 900 W | 700 W |

In order to prevent the total amount of the electric power consumed by the combination of the first and second fixes 9A and 9B, from exceeding 1,600 W in the high and low gloss print modes, the main control 100 controls the timing with which the heaters H1 and H2 of the first fix 9A, and the heaters H3 and H4 of the second fix 9B, are turned on or off, so that the total amount of the electric power consumed by the combination of the heaters H1 and H2, and the total amount of the electric power consumed by the combination of the heaters H3 and H4, do not exceed the corresponding values in Table 1.

1) Low Gloss Print Mode

Given below is the description of the printing tests carried out in the low gloss mode with the electric power allocated as shown in Table 1 (electric power allocation: 1,200 W for first fix 9A, and 400 W for second fix 9B).

The tests were carried out with the recording medium conveyance speeds (process speeds) of the image formation portions, first fix 9A, and second fix 9B set to 200 mm/sec., and the number of prints to be yielded per minute (throughput) set to 50 PPM (normal throughput).

Figure 4:
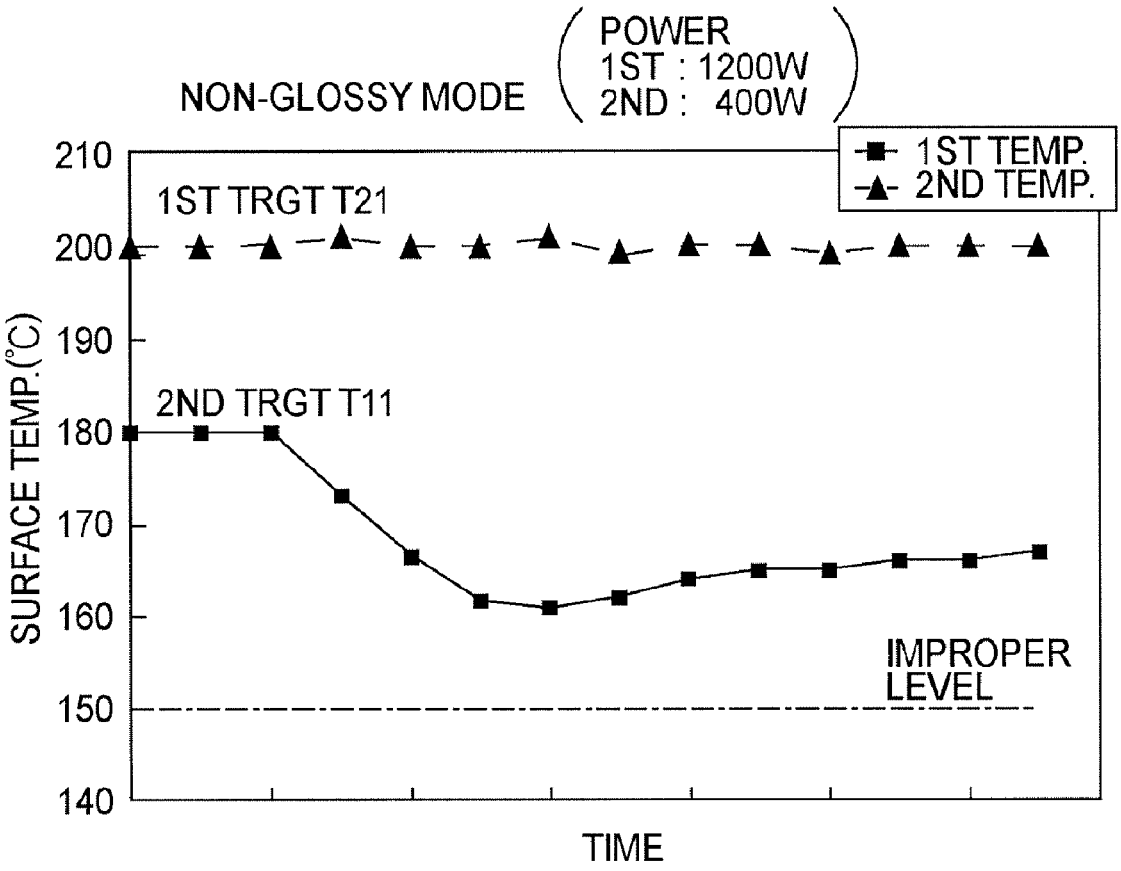
FIG. 4 is a graph showing the temperature changes which occurred to the first and second fixing devices in the low gloss print mode.

FIG. 4 shows the changes which occurred to the surface temperature (first fixation temperature) of the fixation roller 51 of the first fix 9A, and the surface temperature (second fixation temperature) of the fixation roller 151 of the second fix 9B, when multiple copies were continuously yielded in the gloss-less print mode, using high quality paper with a basis weigh of 105 g.

The image forming operation was started with the first fixation temperature being at the target level T11 (first target level), which was 180° C. With the introduction of a sheet of recording medium, the first fixation temperature temporarily fell to roughly 160° C., and then, tended to gradually rise toward the target level T11. The reason for this tendency is that the silicon rubber layer 51*b*, as an elastic layer, on the metallic core 51*a* of the fixation roller 51 functioned as a heat insulating layer. Thus, even though the heater H1 in the hollow of the fixation roller 51 supplied a sufficient amount of heat in response to the decrease in the surface temperature of the fixation roller 51, which occurred as heat was robbed from the surface of the fixation roller 51 by the introduced sheet of recording medium, it took a certain length of time for the heat generated by the heater H1 to reach the surface of the fixation roller 51.

If the first fixation temperature falls to 150° C. or below, the fix 9A decreases in image fixation performance; such a fixation failure that the toner layer of a solid portion of an image peeled from the sheet of recording medium occurs. According to the results of this test, the first fixation temperature was kept above 150° C. Therefore, fixation failure did not occur.

As for the second fixation temperature, it remained at the target temperature T21 (second fixation temperature), which was 200° C., because, in the low gloss print mode, a sheet P of recording medium was not introduced into the second fix 9B.

2) High Gloss Print Mode

Next, the results of the printing test carried out in high gloss print mode will be described.

2-1) Comparative Test 1

Figure 5:
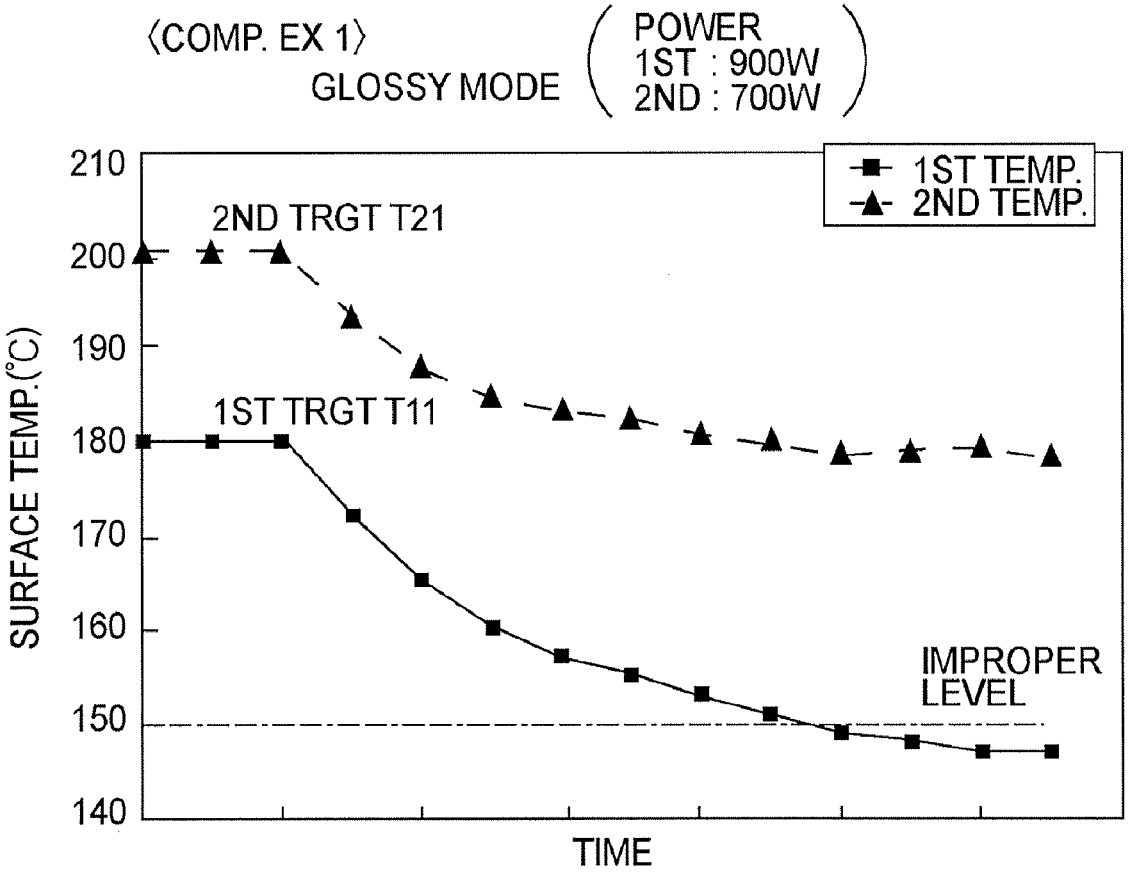
FIG. 5 is a graph showing the temperature changes which occurred to the first and second fixing devices in the high gloss mode, in the first comparative fixing apparatus.

FIG. 5 shows the changes which occurred to the first and second fixation temperatures when multiple copies were continuously printed, with the image forming apparatus set to the high gloss print mode (electric power allocation: 900 W for first fix 9A and 700 W for second fix 9B).

The first fixation temperature gradually fell from the first target level T11 of 180° C., falling eventually below 150° C., below which fixation failure occurs. The reason for this result is as follows: The amount of electric power allocated for the heaters in the fixation rollers of the first fix 9A was reduced from 1,200 W, which was allocated for the heaters of the fixation roller of the first fix 9A when in the low gloss print mode, to 900 W, which was allocated for the fixation rollers when in the high gloss print mode, making thereby insufficient the amount of electric power available for fixation. Further, the second fixation temperature also gradually fell from the second target level T21 of 200° C., falling eventually to roughly 180° C.

In this comparative test 1, the first fixation temperature eventually fell below 150° C., and fixation failure occurred. In order to avoid the occurrence of fixation failure, it is necessary to detect whether or not the first fixation temperature has fallen close to the temperature level below which fixation failure occurs, so that if it has fallen close to the temperature level below which fixation failure occurs, image formation and recording medium conveyance can be stopped to wait for the recovery of the first fixation temperature.

In this test, the level of the glossiness at which an image is formed fell from a glossiness level of 50, at which it was at the early period of the printing operation, to a glossiness level of 30;it changed substantially. The instrument used for the measurement of the glossiness level was a PG-1 of 60° Type (product of Nippon Denshoku Inc.).

2-2) Comparative Test 2

The comparative test 2 is a modification of the above described first comparative test 1; the electric power allocation was changed from the one in the first test so that 1,100 W was allocated for the first fix 9A, and 500 W was allocated for the second fix 9B.

Figure 6:
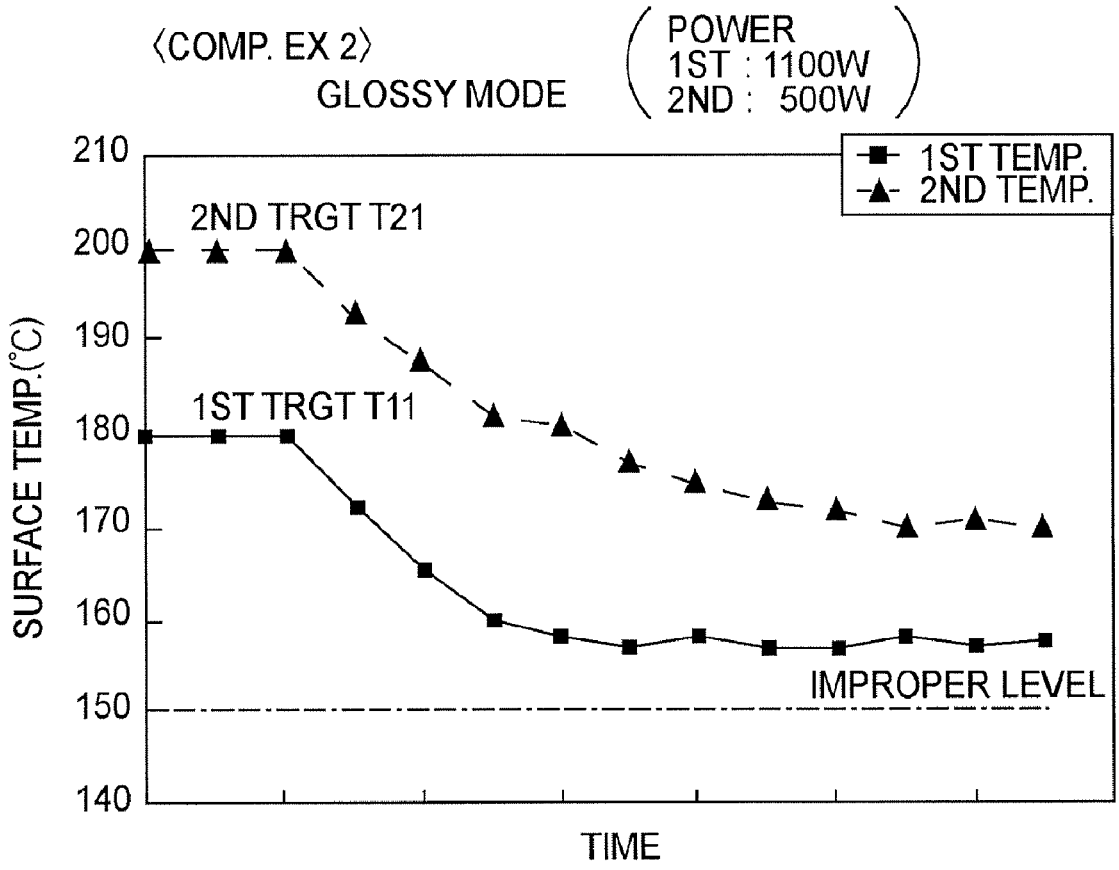
FIG. 6 is a graph showing the temperature changes which occurred to the first and second fixing devices in the high gloss mode, in the second comparative fixing apparatus.

FIG. 6 shows the changes which occurred to the first and second fixation temperatures in the second comparative test 2.

The first fixation temperature gradually fell from the first target level T11 of 180° C., lingering in the adjacencies of 160° C., never falling below 150° C., below which fixation failure occurs. As for the second fixation temperature, it gradually fell from the second target level T21 of 200° C., eventually lingering near 170° C.

As for the changes in the level of glossiness at which copies were outputted in the second comparative test 2, it was at a level of roughly 50 during the early period of the printing operation, falling eventually to roughly 15, which was roughly the same level of glossiness as that achieved in the low gloss print mode. In other words, the selection of the high gloss print mode became meaningless.

2-3) Test of Embodiment 1

In the first embodiment, the amounts of the electric power allocated for the first and second fixes 9A and 9D in the high gloss print mode, were 900 W and 700 W, respectively.

The first target temperature level T11 was set to 180° C., and the referential temperature level T12 (which hereinafter will be referred to as down temperature), which was to be lower than the first target level T11, was set to 160° C. Further, the second fixation target temperature level T21 was set to 200° C., and the down temperature level T22, which was to be lower than the target level T21, was set to 190° C. The down temperature levels were set to values between the first or second fixation temperature target level T11 or T21, and the fixation failure occurrence temperature level at or below which it could not be ensured that satisfactory fixation was achieved.

Figure 7:
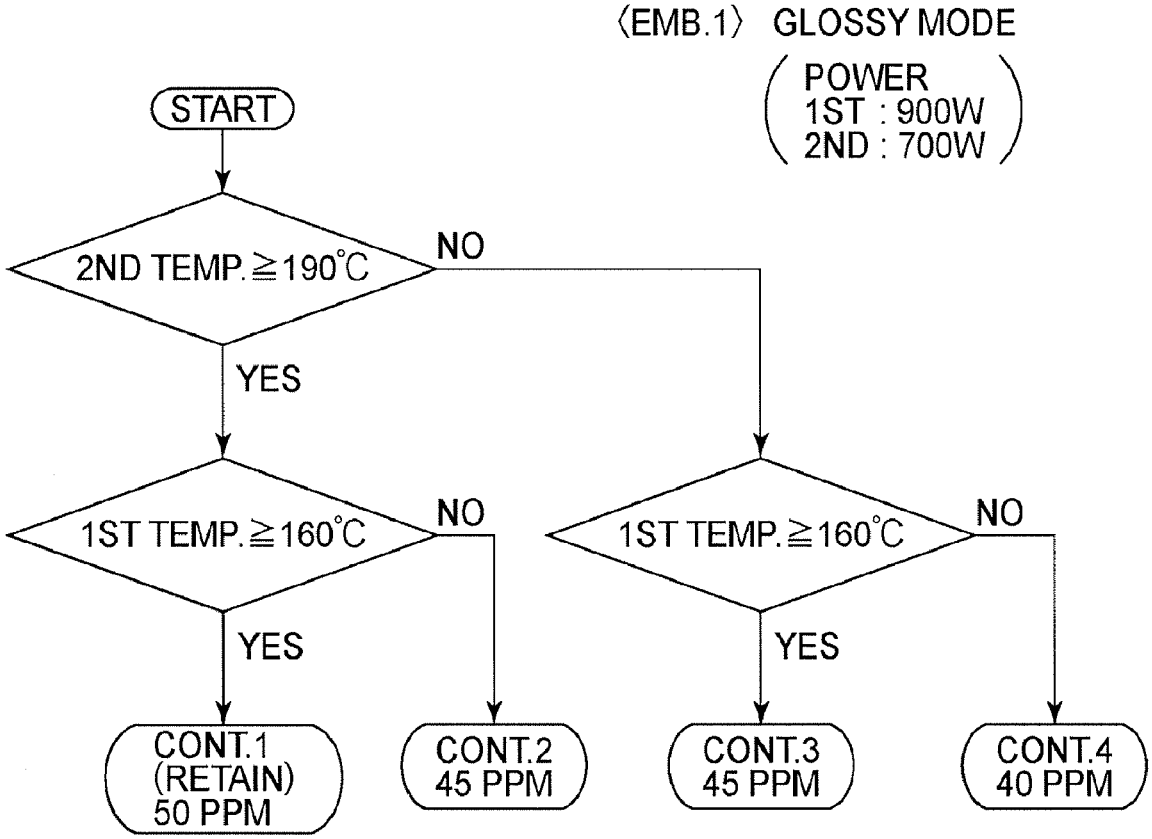
FIG. 7 is a logic chart describing how the throughput is controlled in the high gloss mode, in the first embodiment.

The first and second fixation temperatures detected by the thermistors TH1 and TH3 are compared, by the main control 100, with the above described down temperature levels T12 and T22, respectively, stored as the referential data in the memory. Then, they are fed back to a throughput controlling portion 102 (FIG. 3) through the main control 100. Then, the throughput is controlled following the flowchart in FIG. 7 (recording medium conveyance intervals (sheet intervals) are controlled).

More specifically, the main control 100 and throughput controlling portion 102 carry out the control sequence for switching the number (throughput) of the sheets of recording medium to be conveyed per unit length of time, based on the combination of the result of the comparison between the detected temperature level of the first fix 9A and the down temperature T12, and the result of the comparison between the detected temperature level of the second fix 9B and the down temperature T22.

Control 1: If the second fixation temperature detected by the thermistor TH3 is no less than the down temperature T22 (190° C.), and the first fixation temperature detected by the thermistor TH1 is no less than the down temperature T12 (160° C.), the main control 100 causes the image forming apparatus to carry out an intended image forming operation at the normal process speed of 50 PPM, that is, without switching the throughput of the image forming apparatus with the use of the throughput controlling portion 102.

Control 2: If the second fixation temperature detected by the thermistor TH3 is no less than the down temperature T22 (190° C.), but, the first fixation temperature detected by the thermistor TH1 is no more than the down temperature T12 (160° C.), the main control 100 causes the image forming apparatus to carry out an intended image forming operation at a reduced process speed of 45 PPM, with the use of the throughput controlling portion 102.

Control 3: If the second fixation temperature detected by the thermistor TH3 is no more than the down temperature T22 (190° C.), but the first fixation temperature detected by the thermistor TH1 is no less than the down temperature T12

(160° C.), the main control 100 also causes the image forming apparatus to carry out an intended image forming operation at a reduced process speed of 45 PPM, with the use of the throughput controlling portion 102.

Control 4: If the second fixation temperature detected by the thermistor TH3 is no more than the down temperature T22 (190° C.), and the first fixation temperature detected by the thermistor TH1 is no more than the down temperature T12 (160° C.), the main control 100 causes the image forming apparatus to carry out an intended image forming operation at a reduced process speed of 40 PPM, with the use of the throughput controlling portion 102.

Figure 8:
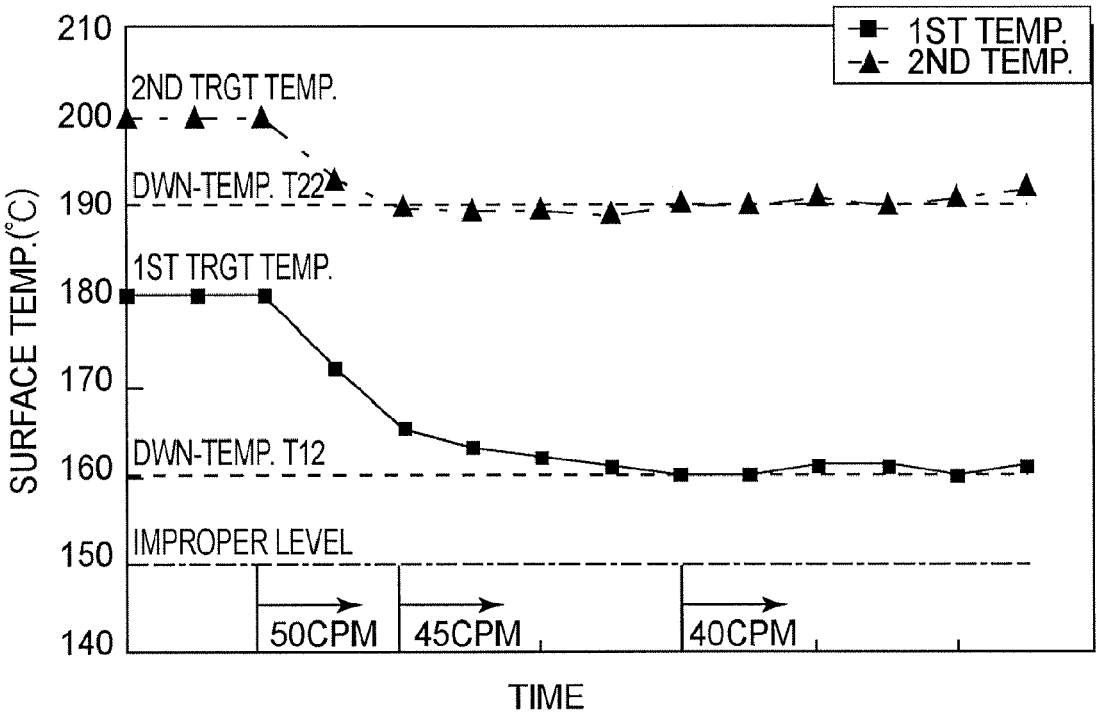
FIG. 8 is a graph showing the temperature changes which occur to the first and second fixing devices in the high gloss mode, in the first embodiment.

FIG. 8 shows the changes which occurred to the first and second fixation temperatures while the above described throughput control sequence was carried out. The first and second fixation temperatures were reduced by the continuous printing. However, as the throughput was reduced in steps with the use of the control method shown in FIG. 7, the first and second fixation temperatures eventually settled, with the first and second fixation temperatures remaining above 160° C. and 190° C., respectively, and the level of glossiness at which images were formed by the image forming apparatus remained within the range of 40-50; the image forming apparatus remained stable in terms of the level of glossiness at which it formed images.

TABLE 2

| | Productivigy | Fixing property | Glossiness | Variation |
|---|---|---|---|---|
| Comp. Ex 1 | G | N | F | 50-30 |
| Comp. Ex 2 | E | G | N | 50-15 |
| Emb. 1 | G | G | E | 50-45 |

E: Excellent:
G: Good:
F: Fair
N: No good:

Based on the studies of the results of the above described tests, it seems that the changes in the first fixation temperature affects image fixation, but has little effect upon the level of glossiness achieved by the second fixation.

The reason for this seems to be as follows. That is, comparing the first and second fixes 9A and 9B in terms of structure, the first fix 9A is designed to perform the fixation process for heating for a relatively long time (nip NA being wider) at a relatively low temperature (T11≦T21), whereas the second fix 9B is designed to perform the fixation process for heating a relatively short time (nip NB being narrower) at a relatively high temperature. With the employment of such nip structures, the first fix 9A functions to achieve a higher level of fixation, by slowly and thoroughly heating the layered toner images, even to the deepest part of the toner image layers, that is, by melting the toner layers all the way to the adjacencies of the interface between the sheet of recording medium and the toner layers, at a relatively low temperature, whereas the second fix 9B functions to heat only the surfaces of the toner layers, and the immediately below the surfaces, to increase in gloss the surfaces of the toner layers (toner images) by flattening the surfaces.

Simply for the purpose of making it easier to understand these processes, they may be compared to a familiar process such as cooking a piece of meat, an egg, or the like. That is, slowly heating a piece of meat, for example, at a relatively low temperature with the use of a frying pan allows heat to penetrate the meat without burning its surface. Similarly, slowly heating the toner layers in the fixation nip makes it possible to allow heat to penetrate to the deepest portions of the toner layers to fully melt the toner layers all the way to the interface between the toner layers and sheet of recording medium, in order to ensure that the toner layers will be thoroughly adhered to the sheet of recording medium, that is, with the presence of no gap between the toner layers and recording medium. In this situation, even if the pressure applied to the toner images is relatively small, a satisfactory level of fixation can be achieved as long as the heating time is long.

On the other hand, heating a piece of meat for a relatively short length of time at a high temperature with the use of a frying pan makes it possible to char the surface of the meat without allowing heat to penetrate deep into the meat. Similarly, quickly heating the toner layers at a high temperature in the fixation nip makes it possible to heat only the surfaces of the toner layers, to flatten the surfaces by eliminating the peaks and valleys of the surfaces, in order to yield an image with a high level of gloss, provided that the pressure applied to the toner layers is sufficiently high.

Thus, as far as the glossiness after the second fixation in the high gloss mode is concerned, the second fix 9B plays the dominant role. Therefore, even if an image is relatively low in gloss after the fixation by the first fix 9A, it is possible that the image will be high in gloss after the fixation by the second fix 9B, provided that the fixation by the second fix 9B is sufficient.

As will be evident from the above explanations, it is important that the down temperature T12 for the first fix 9A is set for achieving a high level of fixation, whereas the down temperature T22 for the second fix 9B is set for stabilizing the level of glossiness at which an image is yielded.

Therefore, by setting the down temperature T22 for the second fix 9B higher than the down temperature T12 for the first fix 9A (T12≦T22), or setting the down temperatures T12 and T22 for the first and second fixes 9A and 9B, respectively, so that "first fixation temperature target T11–down temperature T12" of the first fix 9A becomes greater than "second fixation temperature target T21–down temperature T22" ((T11–T12)≦(T21–T22)), it is possible to yield high gloss prints at as high a rate as possible, while ensuring that toner layers (images) are satisfactorily fixed and the level of glossiness at which prints are yielded remains stable at a preset level.

In this embodiment, the (T11–T12) of the first fix 9A was set to 20° C. (=180–160° C.), and the (T21–T22) was set to 10° (=200–190° C.). However, this setup is not intended to limit the scope of the present invention.

Further, the present invention makes it possible to yield high gloss prints at a as high a rate as possible, while ensuring that not only is satisfactory fixation achieved, but also, the level of glossiness at which the images are yielded remains stable at a preset desired level, regardless of the type and basis weight of recording medium, and operational conditions such as ambient temperature.

Moreover, even if a printing job is such a job that is a mixture of portions to be printed in the high gloss mode, and portions to be printed in the low gloss mode, the present invention makes it possible to yield high gloss prints at a as high a rate as possible, while ensuring that satisfactory fixation is achieved and the level of glossiness at which prints are yielded remains stable at a preset desired level.

In this embodiment, only one down temperature was set for each of the first and second fixes 9A and 9B (T12 and T22, respectively). However, two or more down temperatures may be set for each of the first and second fixes 9A and 9B for more precise control, and such a setup is not problematic at all.

Further, a temperature which is lower than the lowest down temperature may be set as a stop temperature for stopping the on-going printing operation.

In this embodiment, down temperatures were preset, and throughput was changed based on whether or not the fixation temperatures reached the preset down temperatures However, a criterion other than the one in this embodiment may be employed as the criterion used for changing the throughput. For example, the rate at which the fixation temperatures fall per unit length of time, or per preset number of outputted prints may be calculated so that the throughput can be changed if the calculated falling rate of the fixation temperatures is greater than a preset value. Such a setup is just as effective as the one in this embodiment. In such a case, the value of the falling rate of the temperature of the first image heating member, based on which the throughput is changed, is desired to be greater than the value of the falling rate of the temperature of the second image heating means. In other words, the changes in the temperature of the second image heating means which has greater effects on the glossiness of an image than that of the first image heating means, needs to be rendered smaller than the changes in the temperature of the first heating means.

Embodiment 2

In this embodiment, an image forming apparatus which is the same in configuration as the one used in the first embodiment (FIG. 1) was used. In the first embodiment, the first fixing device 9A was basically made up of a pair of rollers, that is, the fixation roller and pressure roller. In this embodiment, however, the first fixing device 9A was made up of a fixation roller, and a fixation belt stretched around multiple rollers. It was structured so that the fixation belt was kept pressed on the fixation roller by a pressing member disposed on the inward side of the fixation roller loop.

Figure 9:
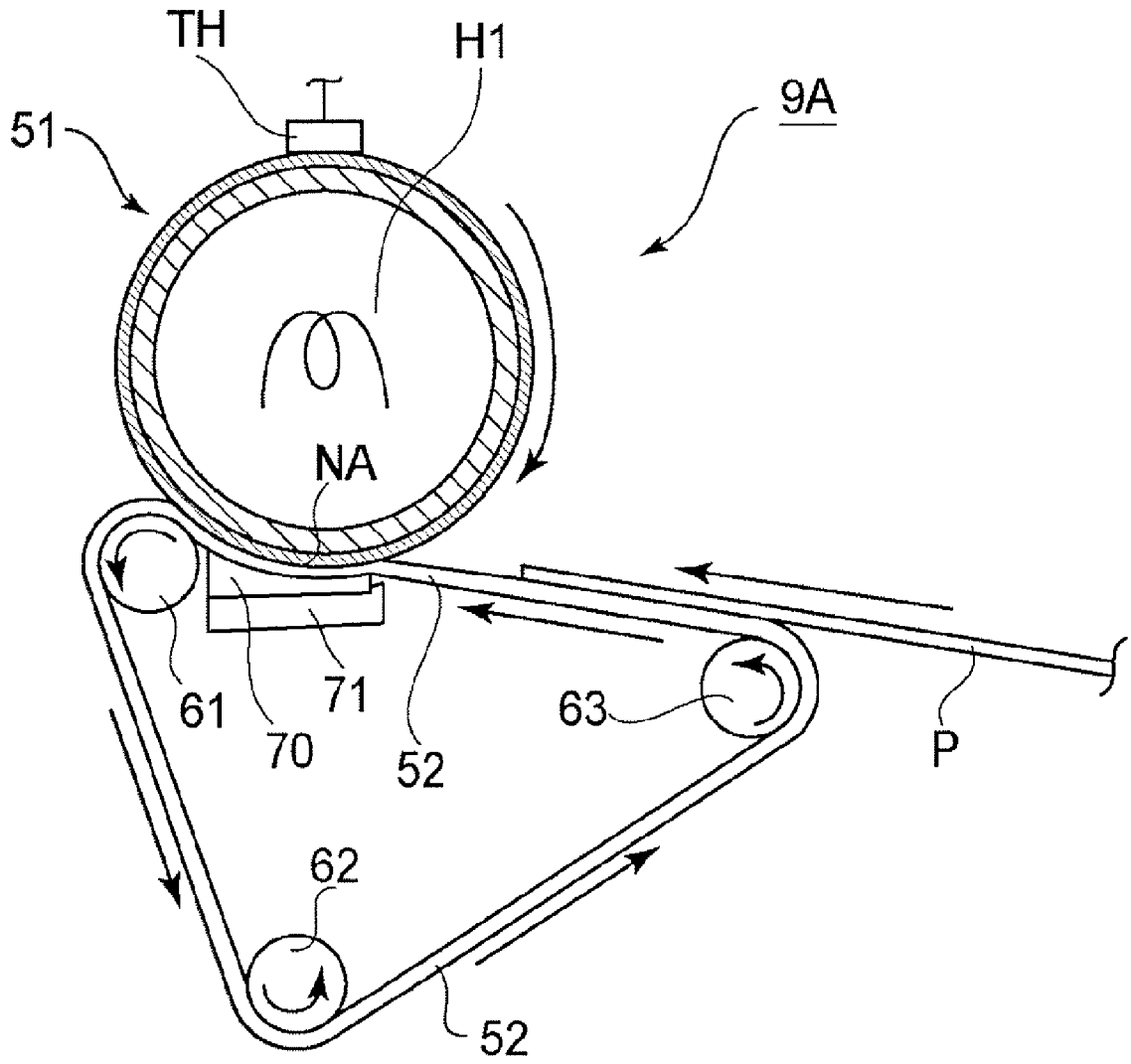
FIG. 9 is a schematic drawing of the heating apparatus of the belt type, which is used as the first fixing device, in the second embodiment, showing the general structure thereof.

More specifically, referring to FIG. 9, the first fixing device 9A in this embodiment comprises: a rotationally disposed fixation roller 51; multiple rollers 61, 62, and 63; an endless fixation belt 52 which is stretched, being thereby suspended, around the multiple rollers 61, 62, and 63, and is rotated while being pressed upon the fixation roller 51; a pressure application pad 70 for pressing the fixation belt 52 upon the fixation roller 51; and a pressure application pad supporting member 71.

The fixation roller 51 is made up of a metallic core formed of aluminum, iron, or the like, and an elastic layer formed of silicon rubber, fluorinated rubber, or the like, in a manner of coating the peripheral surface of the metallic core. The fixation belt is made up of a substrate formed of such a resin as polyimide, or such a metallic substance as nickel, and an elastic layer formed of silicon rubber, fluorinated rubber, or the like, in a manner of coating the surface of the substrate.

Within the hollow of the fixation roller 51, a heater H1 such as a halogen lamp is disposed, as a heater is disposed in the fixation roller 51 in the first embodiment. Further, a thermistor TH1 as a temperature detecting means is disposed in contact, or almost in contact, with the fixation roller 51. The surface temperature of the fixation roller 51 is controlled by controlling the voltage applied to the heater H1 through a temperature control circuit.

A roller 61 is a separation roller formed of a metallic substance. It is kept pressed upon the fixation roller 51, in a manner of apparently biting into the fixation roller 51, with the fixation belt 52 being between the separation roller 61 and fixation roller 51, deforming thereby the elastic layer of the fixation roller 51 so that a sheet P of recording medium is separated from the surface of the fixation roller 51.

As the fixation roller 51, fixation belt 52, and pressure application pad 70 are used to form a fixation nip NA as described above, such a fixation nip NA is formed that is wide enough to partially wrap the peripheral surface of the fixation roller 51 in the circumferential direction of the fixation roller 51. Therefore, this embodiment is advantageous from the standpoint of increasing the fixation speed.

In order to increase, in fixation nip width, a fixing device made up basically of only a pair of rollers, the elastic layer of its fixation roller must be increased in thickness, which renders such a fixing device inferior in terms of energy conservation. In comparison, in the case of a fixing apparatus such as the one in this embodiment which employs such a fixation belt as the above described one, a wider nip can be formed without increasing the elastic layer of the fixation roller 51 in thickness, eliminating thereby the problem that the increase in the thickness of the elastic layer reduces the elastic layer in thermal conduction, and therefore, more heat is lost while it is conducted through the elastic layer. Thus, the fixing apparatus in this embodiment is advantageous from the standpoint of energy conservation.

Further, the employment of the fixation belt made it possible to form a wider fixation nip, without increasing the amount of pressure applied for the formation of the fixation nip. In this embodiment, the pressure applied for the formation of the fixation nip in the first fixing device 9A was set to 700 N to achieve a nip width of 22 mm, as it was in the first embodiment. Because of the wider nip width, the fixation failure occurrence temperature was 130° C. The heating apparatus in this embodiment was subjected to the same test as the one in the first embodiment, with the first fixation temperature target T11 set to 160° C. and the down temperature T12 set to 140° C., under the same conditions as those in the first embodiment. As a result, it was confirmed that the fixing apparatus in this embodiment was just as effective as the one in the first embodiment, despite the conditions under which the test was conducted.

As described above, it was confirmed that even when the present invention was applied to a fixing apparatus structured to apply an ample amount of heat to recording medium by widening the fixation nip with the employment of the fixation belt, the same effects as those obtained in the first embodiment were obtainable.

Incidentally, in each of the preceding two embodiments of the present invention, two fixing devices were mounted in the housing of an image forming apparatus. However, the two embodiments were not intended to limit the scope of the present invention. For example, the following configuration may be employed: While the first fixing device is disposed within the housing of an image forming apparatus, a unit having the second fixing device as an image gloss increasing means is provided as an optional unit (gloss increasing apparatus), which is removably attachable to the image forming apparatus.

Even a conventional structural setup for image fixation has been satisfactory in that images are satisfactorily fixed even in a job in which multiple sheets of recording medium are continuously fed to form an image thereon. However, in the case of a conventional structural setup for image fixation, the level of glossiness achievable with the use of a conventional setup has fallen with the progression of the job. In comparison, each of the preceding embodiments of the present invention makes it possible to prevent an image forming apparatus from deteriorating in terms of the level of glossiness at which it can form an image, without interrupting image formation. In other words, each of the embodiments can stabilize an image formation in terms of the level of glossiness at which the image forming apparatus forms an image; the images formed in each job are virtually uniform in quality.

In other words, the present invention can prevent an image forming apparatus from becoming nonuniform in terms of image gloss, due to the insufficiency in the amount of the heat available for image fixation, while preventing the image forming apparatus from falling in productivity.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 361699/2004 filed Dec. 14, 2004 which is hereby incorporated by reference.

What is claimed is:

1. A system for improving a glossiness of an image, the system comprising:

a fixing device having a fixing member which heat fixes a toner image on a recording material in a fixing nip portion, said fixing device being controlled so that said fixing member maintains a first target temperature;

a glossiness improving device having a glossiness improving member which improves a glossiness of the toner image fixed by said fixing device on the recording material by heat in a heating nip portion that has a width, measured in a direction of movement of the recording material, which is smaller than that of the fixing nip portion, said glossiness improving member being controlled so that said glossiness improving member maintains a second target temperature; and an executing device for executing an operation in a mode in which a reduced number of recording materials are passed through said fixing device and said glossiness improving device per unit time, when at least one of lowering of the temperature of said fixing member to a first predetermined temperature and lowering of the temperature of said glossiness improving member to a second predetermined temperature is executed, during glossiness improving operations for a plurality of recording materials, wherein a difference between the second target temperature and the second predetermined temperature is smaller than a difference between the first target temperature and the first predetermined temperature.

2. A system according to claim 1, wherein the second target temperature is higher than the first target temperature during the glossiness improving operations.

3. A system according to claim 1, wherein a nipping pressure of the heating nip portion is larger than that of the fixing nip portion.

4. A system for improving a glossiness of an image, the system comprising:

a fixing device which heat fixes a toner image on a recording material in a fixing nip portion;

a glossiness improving device which improves a glossiness of the toner image fixed by said fixing device on the recording material by heat in a heating nip portion that has a width, measured in a direction of movement of the recording material, which is smaller than that of the fixing nip portion; and an executing device for executing an operation in a mode in which a reduced number of recording materials are passed through said fixing device and said glossiness improving device per unit time, when at least one of lowering of the temperature of said fixing device to a first predetermined temperature and lowering of the temperature of said glossiness improving device to a second predetermined temperature is executed, during glossiness improving operations for a plurality of recording materials, wherein the second predetermined temperature is higher than the first predetermined temperature.

5. An apparatus according to claim 4, wherein a nipping pressure of the heating nip portion is larger than that of the fixing nip portion.

* * * * *